US006443067B2

(12) United States Patent
Kimura

(10) Patent No.: US 6,443,067 B2
(45) Date of Patent: Sep. 3, 2002

(54) SHEET-FED PRINTING PRESS HAVING CONTROL DEVICE FOR CONTROLLING PLATE CYLINDER CLAMPS

(75) Inventor: Takashi Kimura, Fuchu (JP)

(73) Assignee: Ryobi, Ltd., Hiroshima-Ken (JP)

( * ) Notice: Subject to any disclaimer, the term of this patent is extended or adjusted under 35 U.S.C. 154(b) by 0 days.

(21) Appl. No.: 09/858,356

(22) Filed: May 15, 2001

(51) Int. Cl.[7] ..... B41F 27/12
(52) U.S. Cl. ..... 101/415.1; 101/477
(58) Field of Search ..... 101/409, 415.1, 101/477, 410, 378

(56) References Cited

U.S. PATENT DOCUMENTS 4,489,653 A * 12/1984 Cappel et al. ..... 101/415.1

5,868,072 A * 2/1999 Nishi ..... 101/415.1

* cited by examiner

*Primary Examiner*—Leslie J. Evanisko
(74) *Attorney, Agent, or Firm*—Perkins Coie LLP

(57) ABSTRACT

A sheet-fed printing press is provided to shorten the operation time thereof for feeding the printing plate on the plate cylinder in a printing operation without the tail edge of the printing plate clamped. For this purpose, the sheet-fed printing press is operable in the standard-sized printing plate feeding mode and the shorter-sized printing plate feeding mode. When the shorter-sized printing plate feeding mode is selected, the plate cylinder is rotated in the forward direction with the leading edge of the printing plate clamped by the first clamp device, so that the printing plate is wound around the plate cylinder. In this operation, the second clamp device is not actuated.

2 Claims, 5 Drawing Sheets

SHEET-FED PRINTING PRESS HAVING CONTROL DEVICE FOR CONTROLLING PLATE CYLINDER CLAMPS

BACKGROUND OF THE INVENTION

1. Field of the Invention

The present invention relates to a sheet-fed printing press, and more particularly a control mechanism for controlling associated operations of the sheet-fed printing press to mount a printing plate on a plate cylinder.

2. Discussion of the Background

According to a conventional sheet-fed printing press, a printing plate having a leading edge and a tail edge is wound around the outer circumference of a plate cylinder, and ink and dampening solution are fed to the printing plate for the sheet printing. The plate cylinder forms therein a recessed portion, in which a leading edge clamp (first clamp device) for clamping the leading edge of the printing plate and a tail edge clamp (second clamp device) for clamping the tail edge of the printing press are disposed.

The leading edge clamp includes a base part and a movable part to apply a clamping force onto the upper and lower surfaces of the leading edge of the printing plate. Similarly, the tail edge clamp includes a base part and a movable part to apply a clamping force onto the upper and lower surfaces of the tail edge of the printing plate. The tail edge clamp is also designed to move in a first direction to pull the printing plate into tensed state along a sheet feeding passage of the printing press, which passage extends around the outer circumference of the plate cylinder, and in a second direction to release the printing plate from the tensed state along the sheet feeding passage.

A printing plate pressing roller as a printing plate pressing device is disposed near the plate cylinder in such a manner as to be movable to and away from the outer circumference of the plate cylinder for timely pressing the printing plate against the outer circumference of the plate cylinder. An edge insertion device is also disposed near the plate cylinder for guiding the tail edge of the printing plate into the tail edge clamp.

In recent years, attempts have been continuously made to automatize the printing-plate feeding operation, printing-plate removing operation and/or any other associated operations. For example, in the printing-plate feeding operation for feeding the printing plate on the printing cylinder, an operator first inserts the leading edge of the printing plate into the leading edge clamp and then actuates the leading edge clamp to clamp the leading edge of the printing plate. After that, the printing press is automatically operated to perform the subsequent plate feeding actions in the following manner.

The plate cylinder starts to rotate in the forward direction with the leading edge of the printing plate clamped by the leading edge clamp. Along with the forward rotation of the plate cylinder, the printing plate pressing roller moves to the plate cylinder and then presses the printing plate against the outer circumference of the plate cylinder. With continuously pressing the printing plate by the pressing roller, the plate cylinder rotates in the forward direction to a predetermined angular position, so that the printing plate is wound around the plate cylinder and has its tail edge brought into contact with the edge insertion device. The plate cylinder stops its rotation once the tail edge contacts the edge insertion device.

The edge insertion device then guides the tail edge of the printing plate into the tail edge clamp, which then clamps the tail edge therein. At this moment, the printing plate with its leading and tail edges clamped by the respective clamps still does not have the entire length brought into a tight contact with the outer circumference of the plate cylinder. To achieve the tight contact throughout the entire length of the printing plate, the tail edge clamp is moved in the first direction by a predetermined distance, applying pulling force onto the printing plate, thereby bringing the same into tight contact with the outer circumference of the plate cylinder. A series of operations for feeding the printing plate are thus finished. Subsequent to this, the pressing roller is moved away from the plate cylinder, enabling the printing press to start the printing operation.

With respect to the size of the printing plate, a length of the printing plate along the rotational direction of the plate cylinder is usually limited to such a length as to enable both clamps to clamp the respective edges of the printing plate (standard-sized printing plate). However, the printing may sometimes be operated, using a printing plate having a post-card size or any other shorter size, whose both edges cannot reach the respective clamps and therefore tail edge cannot be clamped (shorter-sized printing plate). In such a printing operation without tail edge clamped, only the leading edge of the printing plate is clamped by the leading edge clamp during the printing operation due to the shortness of the length of the printing plate along the sheet-feeding passage.

According to the conventional printing press of the above type, even if the printing plate having a shorter length is fed on the plate cylinder, the tail edge clamp is unnecessarily actuated, and the plate feeding operation cannot be completed before the action of the tail edge clamp is completed, so that the operator must wait the completion of the action of the tail edge clamp. With such a problem there exists a demand for an improved printing press that is capable of shortening a printing plate feeding operation time.

Therefore, in consideration of solving the above problem it is an object of the present invention to provide an improved printing press that is capable of carrying out the printing press feeding operation in a reduced time period when the printing operation without tail edge clamped is to be carried out.

SUMMARY OF THE INVENTION

According to the present invention, there is provided a sheet-fed printing press that includes a plate cylinder, a first clamp device, a second clamp device, and a control device. The plate cylinder is rotatable in the forward direction and the reverse direction, and has an outer circumference around which a printing plate having a leading edge and a tail edge located opposite to each other is wound. The first clamp device is disposed on the plate cylinder for clamping the leading edge of the printing plate. The second clamp device is disposed on the plate cylinder for clamping the tail edge of the printing plate, and is movable in a first direction to pull the printing plate into tensed state and in a second direction to release the same from the tensed state. The control device is provided for controlling the printing press, so that the printing press is operable in a standard-sized printing plate feeding mode for feeding a printing plate having a standard size on the outer circumference of the plate cylinder and a shorter-sized printing plate feeding mode for feeding a printing plate having a shorter size than the standard size on the outer circumference of the plate cylinder.

According to the above arrangement, when the standard-sized printing plate feeding mode is selected, the control device controls the printing press so that the plate cylinder is rotated in the forward direction with the leading edge of the printing plate clamped by the first clamp device, thereby enabling the printing plate to be wound around the plate cylinder, and the second clamp device clamps the tail edge and is moved in the first direction. thereby pulling the printing plate into tensed state. Whereby, the printing plate is brought into tight contact with the outer circumference of the plate cylinder. Thus, the printing plate feeding operation is completed.

On the contrary, when the shorter-sized printing plate feeding mode is selected, the control device controls the printing press so that the plate cylinder is rotated in the forward direction with the leading edge of the printing plate clamped by the first clamp device. Whereby, the printing plate can be wound around the plate cylinder. Thus, the printing plate operation is completed without actuation of the second clamp member.

In the above arrangement, the standard-sized printing plate feeding mode is selected to wind around the plate cylinder the printing plate whose length is a standard size, enabling both clamps to respectively clamp the leading and tail edges. The shorter-sized printing plate feeding mode is selected to wind around the plate cylinder the printing plate whose length is not so long as to extend between both clamp devices.

With the above arrangement, the sheet-fed printing press of the present invention is operable in the shorter-sized printing plate feeding mode besides the standard-sized printing plate feeding mode, so that the operator can suitably select the plate feeding mode according to the size of the printing plate. Thus, the plate feeding operation time for the shorter-sized printing plate may be shortened.

A sheet-fed printing press may also be operable in a standard-sized printing plate removing mode and a shorter-sized printing plate removing mode. According to these operational modes, when the standard-sized printing plate removing mode is selected, the control device controls the printing press so that the plate cylinder is rotated in the reverse direction with the tail edge of the printing plate released from clamped engagement with the second clamp device. When the shorter-sized printing plate removing mode is selected, the control device controls the printing press so that the plate cylinder is rotated in the forward direction with the leading edge of the printing plate released from clamped engagement with the first clamp device.

In the above arrangement, the standard-sized printing plate removing mode is selected to remove from the plate cylinder the printing plate having a standard size with the leading and tail edges clamped by both clamp devices. The shorter-sized printing plate removing mode is selected to remove from the plate cylinder the printing plate having a shorter size than the standard size with only the leading edge clamped by the first clamp device.

When the standard-sized printing plate removing mode is selected, the operator can hold the released tail edge of the printing plate by hand, and remove the same away from the plate cylinder through the reverse rotation of the plate cylinder. When the shorter-sized printing plate removing mode is selected, the operator can hold the released leading edge of the printing plate by hand, and remove the same away from the plate cylinder through the forward rotation of the plate cylinder.

Where the printing press is operable in the shorter-sized printing plate removing mode besides the standard-sized printing plate removing mode, as described above, a suitable plate removing mode may be selected according to the size of the printing plate. Particularly in the shorter-sized printing plate removing mode, the control device controls the plate cylinder to forwardly rotate. This forward rotation prevents the printing plate from being accidentally removed from the plate cylinder and then curling up, so that the printing plate can removed from the plate cylinder in easy and secured manner.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

An embodiment of the sheet-fed printing press according to the present invention will be hereinafter described with reference to FIGS. 1 to 5.

Figure 1:
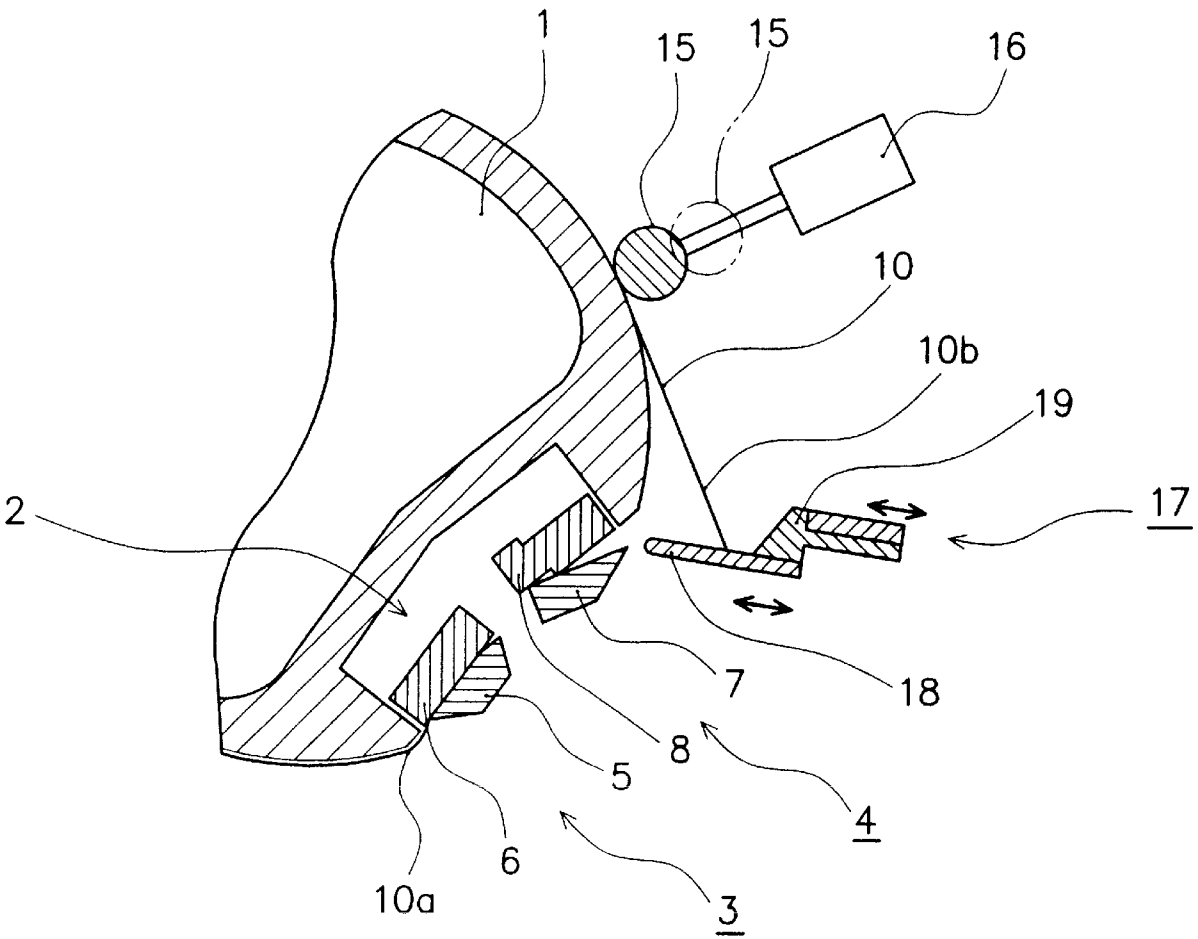
FIG. 1 is a cross section of an essential portion of the sheet-fed printing press according to one embodiment of the present invention.
Figure 2:
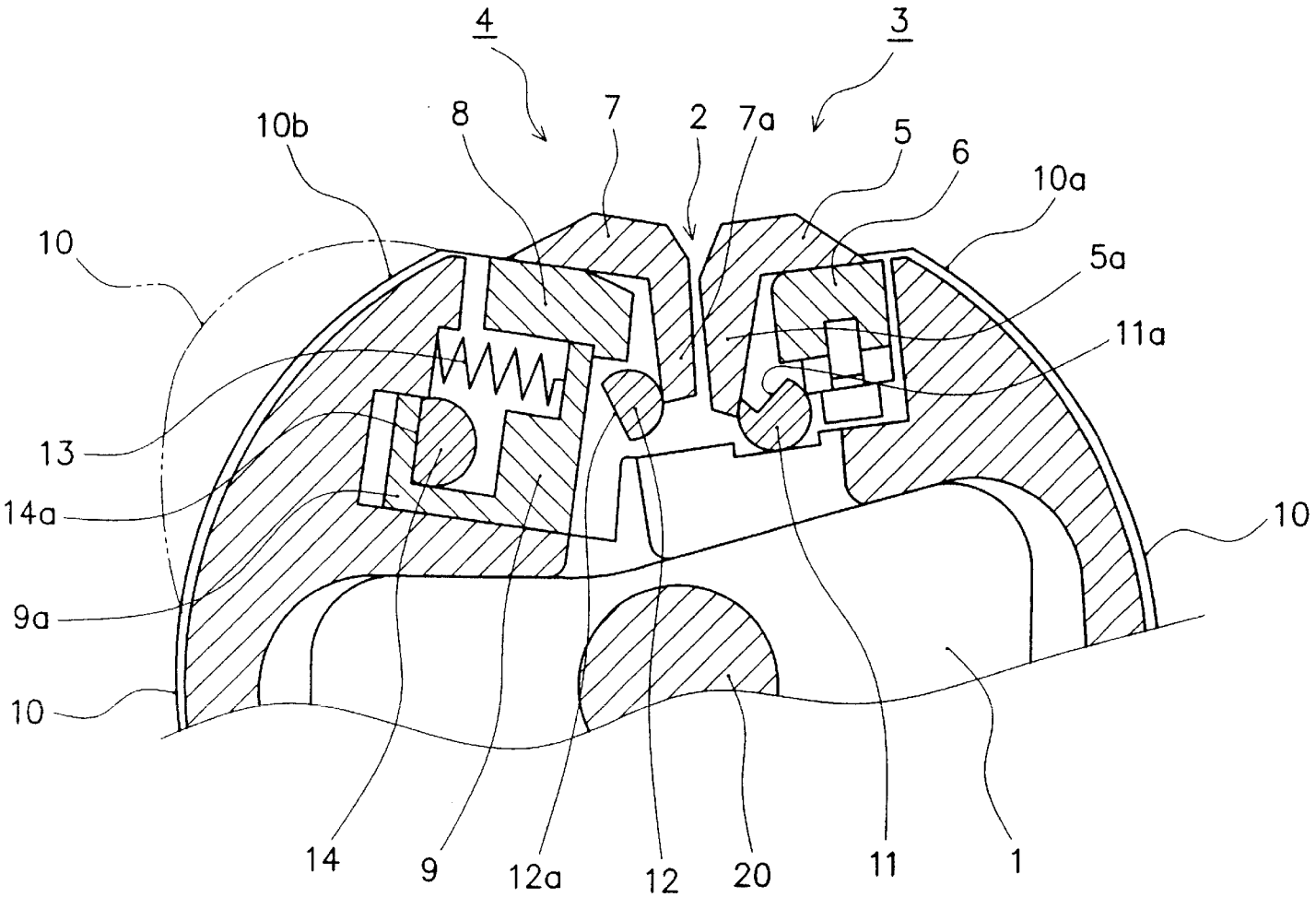
FIG. 2 is another cross section of an essential portion of the sheet-fed printing press.

As illustrated in FIG. 1, a plate cylinder 1 forms therein a recessed portion 2, in which a leading edge clamp 3 and a tail edge clamp 4 are disposed. The leading edge clamp 3 includes a base part 6 and a movable part 5 that is adapted to be moved to and away from the base part 6, enabling the leading edge clamp 3 to take an open position and closed position. Also, the tail edge clamp 4 includes a base part 8 and a movable part 7 that is adapted to be moved to and away from the base part 8, enabling the tail edge clamp 4 to take an open position and closed position. The leading edge clamp 3 clamps the leading edge 10*a* of the printing plate 10 upon taking the closed position, and the tail edge clamp 4 clamps the tail edge 10*b* of the printing press 10 upon taking the closed position. There is provided a first driving device that is capable of opening and closing the movable parts 5 and 7, for which various conventional mechanisms such as a camming mechanism may be employed. An example of the first driving device is illustrated in FIG. 2.

The movable parts 5 and 7 each are formed into a substantially L-shape in cross section, and respectively have rear ends 5*a* and 7*a* that extend radially inwardly towards the axial center of the plate cylinder 1 and are constantly biased via spring members or the like in such a direction to move into the open positions. Cam shafts 11 and 12 are disposed so as to respectively apply pressing forces onto the rear ends 5*a* and 7*a*, and respectively form therein cut-away portions 11*a* and 12*a*. With this arrangement, the cam shafts 11 and 12 are rotated to contact via their outer circumferences the rear ends 5*a* and 7*a* as illustrated in FIG. 2, thereby moving the rear ends 5*a* and 7*a* of the movable parts 5 and 7 into the closed positions against the biasing forces. When the cam shafts 11 and 12 are rotated by a predetermined angular distance, the cut-away portions 11*a* and 12*a* are brought into contact with the rear ends 5*a* and 7*a* of the movable parts 5 and 7, so that the movable parts 5 and 7 are brought into the open positions through the biasing forces.

On the other hand, the movable part 7 and the base part 8 of the tail edge clamp 4 are designed to be reciprocably moved along the rotational direction of the plate cylinder 1, or moved in a first direction to pull the printing plate 10, which has been wound around the plate cylinder 1, into tensed state and in a second direction to release the same from the tensed state. There is provided a second driving device that is capable of reciprocably moving the tail edge clamp 4, for which various conventional mechanisms may also be employed. In FIG. 2, a spring base 9 is disposed below the base part 8 of the tail edge clamp 4 in engagement with the base part 8, and urged via a spring 13 in such a direction as to pull the printing plate 10 into tensed state (the right hand side direction in FIG. 2). In order to reciprocably move the spring base 9, a cam shaft 14 that forms recessed portion 14*a* on the outer circumference thereof and extends through the spring base 9 is provided. Through the rotation of the cam shaft 14, the outer circumference thereof contacts an upright wall 9*a* (a left-hand side wall in FIG. 2), thereby allowing the spring base 9 to move in the left-hand side direction in FIG. 2 against the biasing force of the spring 13. Through further rotation of the cam shaft 14 by a predetermined angular distance, the cut-away portion 14*a* contacts the left-hand side wall 9*a* as illustrated in FIG. 2. The spring base 9 thus can be moved to the right-hand side through the biasing force by a distance equivalent to a difference between the distances to the recessed portion 14*a* and to the outer circumference respectively from the rotational axis of the cam shaft 14. Along with the spring base 9, the movable part 7 and the base part 8 disposed above the spring base 9 are moved, so that the printing plate 10 can be pulled into tensed state as represented in solid line through the movement of the spring base 9 to the right hand side, and released from tensed state and brought into a loosened state as represented in chain double-dashed line through the movement of the spring base 9. The cam shaft 12 supported on the base part 8 can also be integrally moved along with the movement of the base part 8.

On the other hand, a pressing roller 15 is disposed near the outer circumference of the plate cylinder 1, as illustrated in FIG. 1. This pressing roller 15 is designed to move to and away from the outer circumference of the plate cylinder 1 via a driving device. For the driving device, various conventional mechanisms may be employed. FIG. 1 illustrates one example of the driving device, in which an air cylinder 16 has a cylinder shaft which terminates in the pressing roller 15, so that extension and retraction of the air cylinder 16 causes the contacting and leaving action of the pressing roller 15 with respect to the outer circumference of the plate cylinder 1.

An edge insertion device 17 is disposed away from the pressing roller 15 by a predetermined angular distance with the axis of the plate cylinder 1 as a center to guide the tail edge 10*b* of the printing plate 10 into a space between the movable part 7 and the base part 8. Various conventional mechanisms may also be employed for the edge insertion device 17. FIG. 1 illustrates one example of the edge insertion device 17, which includes a guide plate 18 adapted for supporting the tail edge 10*b* thereon and guiding the same to the tail edge clamp 4, and a pressing member 19 adapted for pressing the tail edge 10*b* along the guide plate 18 to the tail edge clamp 4. Both the guide plate 18 and the pressing member 19 are reciprocably movable to and away from the tail edge clamp 4 via a driving device. Various conventional mechanisms such as an air cylinder may also be employed for this driving device.

Although not illustrated, a cylinder shaft 20 of the plate cylinder 1 is supported in place via bearings by opposite frames, and a driving gear is secured to the cylinder shaft 20. The driving gear is rotated by a driving motor as a driving device for the plate cylinder 1 in such a manner as to forwardly and reversely rotate the plate cylinder 1.

Figure 3:
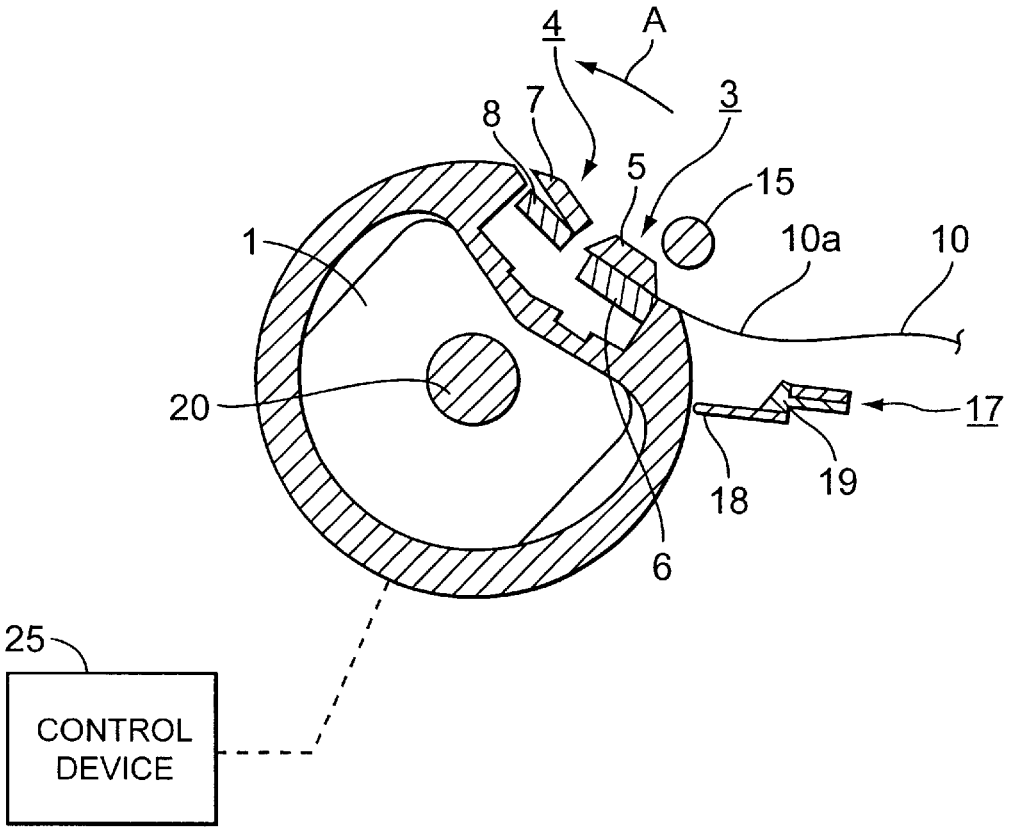
FIG. 3 is still another cross section of an essential portion of the sheet-fed printing press.

An encoder is provided to detect the rotation of the driving gear and, converts it into a signal, which is then transmitted to a control device 25, shown in schematic form in FIG. 3, for central control of the respective mechanisms of the printing press. A detecting element is disposed on an end surface of the plate cylinder 1, facing one of the opposite frames, and a proximity sensor is disposed on the one of the opposite frames for detecting the approaching of the detecting element. Accordingly, the proximity sensor detects the detecting element, which has reached a detecting area of the proximity sensor through the rotation of the plate cylinder 1, and transmits a signal representative of the approaching the detecting element to the control device. Upon receiving the signal, the control device acknowledges an angular position of the plate cylinder 1 with respect to the rotational direction with designating a position of the detecting element detected by the proximity sensor as a reference position, and thus controls the motor to properly drive the plate cylinder 1.

Now, the description will be made for the printing-plate feeding operation to mount the printing plate 10 on the plate cylinder 1.

The printing press of this embodiment is operable in the standard-sized printing plate feeding mode for feeding a standard-sized printing plate 10 on the plate cylinder 1, and in the shorter-sized printing plate feeding mode for feeding a shorter-sized printing plate 10 used for the printing operation without tail edge clamped. The control device controls the respective mechanisms of the printing press according to the selected operational mode.

In the standard-sized plate feeding mode, using the standard-sized printing plate 10, the operator pushes a standard-sized printing plate feeding button on an operation panel of the printing press to actuate the control device that then controls the cylinder driving motor. The plate cylinder 1 is then rotated and stopped at a plate-feeding-position, as illustrated in FIG. 3. This plate feeding position is drawn through a predetermined angular position of the plate cylinder 1, enabling the leading edge clamp 3 to face a safety cover of the printing press through which a printing plate 10 is fed. During this rotation, both movable parts 5 and 7 are held in the open positions.

The operator then places the leading edge 10*a* of the printing plate 10 between the movable part 5 and the base part 6 by opening the safety cover, and again pushes the standard-sized printing plate feeding button. Upon receiving a signal representative of this pushing action, the control device controls the driving device of the leading edge clamp 3. Under this control, the movable part 5 is moved into the closed position, thereby clamping the leading edge 10*a* of the printing plate 10 in cooperation with the base part 6. These actions are also performed in the later-described shorter-sized printing plate feeding mode, except for the switching action to select the shorter-sized printing plate feeding mode.

Figure 4:
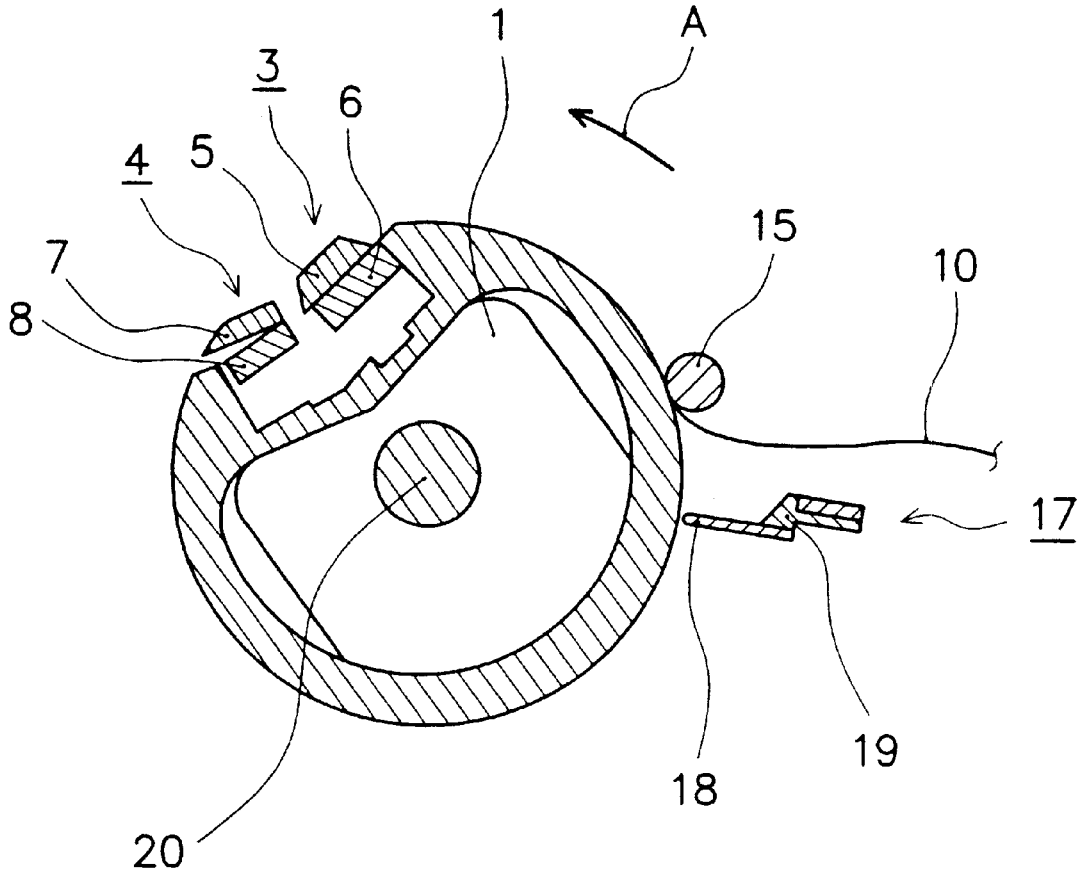
FIG. 4 is another cross section of an essential portion of the sheet-fed printing press.
Figure 5:
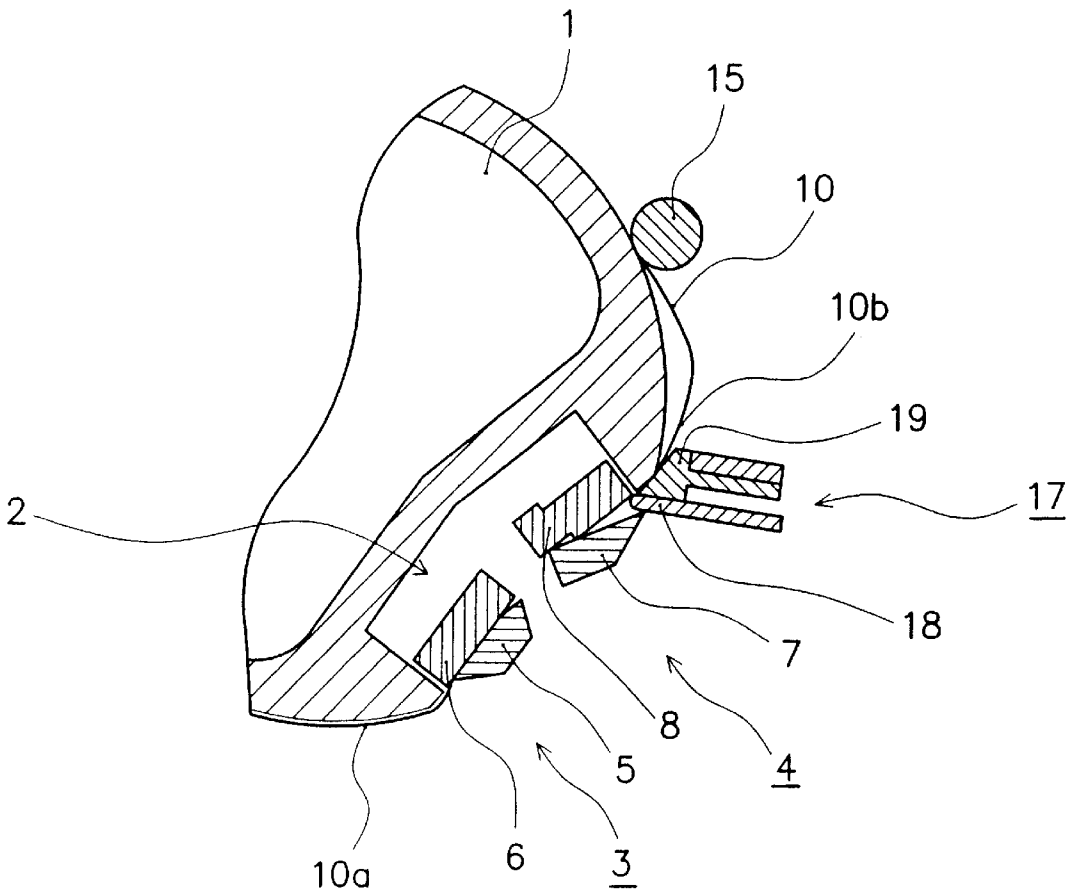
FIG. 5 is another cross section of an essential portion of the sheet-fed printing press.

After the above operation, the operator again pushes the standard-sized printing plate feeding button to automatically perform the subsequent actions in the printing press mounting operation. Specifically, upon receiving-the signal from the standard-sized printing plate feeding button, the control device controls the plate cylinder driving motor to rotate the plate cylinder 1 in the direction indicated by an arrow A in FIG. 3. Once the plate cylinder 1 is rotated in the forward direction by a predetermined angular distance, the air cylinder 16 extends towards the plate cylinder 1 under the control of the control device, so that the pressing roller 15 presses the printing plate 10 against the outer circumference of the plate cylinder 1. As illustrated in FIG. 4, the plate cylinder 1 is rotated in the forward direction with the printing plate 10 pressed against the outer circumference of the plate cylinder 1 by the pressing roller 15, so that the printing plate 10 is automatically wound around the outer circumference of the plate cylinder 1. Once the plate cylinder 1 is rotated to a predetermined angular position where the space between the movable part 7 and the base part 8 faces the guide plate 18 of the edge insertion device 17, the control device stops the plate cylinder driving motor and hence the plate cylinder 1. At this moment, the tail edge 10*b* of the printing plate 10 contacts the guide plate 18.

Subsequent to the stoppage of the plate cylinder 1, the control device actuates the driving device for driving the edge insertion device 17 to move the guide plate 18 and the pressing member 19 from a stand-by position to the tail edge clamp 4, and enable the pressing member 19 to press the tail edge 10*b* into the space between the movable part 7 and the base part 8. After this insertion action, the driving device is reversely driven to return the guide plate 18 and the pressing member 19 to the stand-by position. Once the edge insertion device 17 returns to this stand-by position, the control device actuates the driving device of the tail edge clamp 4 to bring the movable part 7 into the closed position and hence clamp the tail edge 10*b* in cooperation with the base part 8. The control device then actuates the second driving device of the tail edge clamp 4 to move the tail edge clamp 4 in the first direction to pull the printing plate 10 into tensed state. Through this movement of the tail edge clamp 4, the tension force is applied on the printing plate 10, so that the printing plate 10 in a loosened state represented in chain double-dashed line in FIG. 2 is brought into the tensed state as represented in solid line illustrated in the same Figure. Thus, the printing plate 10 tightly contacts the outer circumference of the plate cylinder 1. Subsequent to the completion of the pulling action of the tail edge clamp 4, the control device retracts the air cylinder 16 to move the pressing roller 15 away from the plate cylinder 1. Thus, the standard-sized printing press feeding operation involving these sequential or successive actions is completed.

Now, the description will be made for the shorter-sized printing plate feeding operation to mount the printing plate 10 having a shorter length than the standard sized plate on the plate cylinder 1.

As described above, once the operator pushes the shorter-sized printing plate feeding button, with the leading edge 10*a* clamped by the leading edge clamp 3, the control device receives the signal representative of this action from this button to start the rotation of the plate cylinder 1 in the forward direction, and actuate the pressing roller 15 to press the printing plate 10 against the outer circumference of the plate cylinder 1. The printing plate 10 thus can be wound around the outer circumference of the plate cylinder 1 through this forward rotation. Similarly to the standard-sized printing plate feeding mode, the plate cylinder 1 is forwardly rotated to an edge insertion position as illustrated in FIG. 1 and then stopped at this position. That is, since the printing plate 10 has a shorter length, the winding operation of the printing plate 10 is completed before it reaches the edge insertion position of FIG. 1. On the other hand, the plate cylinder 1 continues its forward rotation until it reaches the edge insertion position in the same manner as the standard-sized printing plate feeding mode. Subsequent to the stoppage of the plate cylinder 1 at the edge insertion position, the pressing roller 15 is moved away from the outer circumference of the plate cylinder 1, and then the printing plate feeding operation is completed. In this case, the printing plate 10 is held on the outer circumference of the plate cylinder 1 via water or the like.

Once the shorter-sized printing plate feeding mode is selected, the control device does not actuate the driving devices of the edge insertion device 17 and the tail edge clamp 4. Therefore, as compared with the case where the printing plate 10 having a shorter size is to be mounted by using the standard-sized printing plate feeding mode, it is possible to reduce the total time needed for the three actions, namely the reciprocal movement of the edge insertion device, the clamping action of the tail edge clamp 4, and the movement of the tail edge clamp 4.

In the above arrangement, the description has been made for the printing press that includes the pressing roller 15 and the edge insertion device 17. In this respect, one or both of these devices may be omitted in the printing press. The shorter-sized printing plate feeding mode with such arrangements also omits the actuation of the tail edge clamp 4 so that the operation time for feeding the shorter-sized printing plate can be shortened by the time period during which tail edge clamp 4 is actuated.

Now, the description will be made for the printing plate removing operation to remove the printing plate 10 from the plate cylinder 1.

The printing press of this embodiment is operable in a shorter-sized printing plate removing mode for removing the printing plate 10 having a shorter size than the-standard size or the printing plate 10 used in the printing operation without tail edge clamped, in addition to a standard-sized printing plate removing mode for removing the printing plate 10 having a standard size.

In the standard-sized printing plate removing mode, the operator pushes a standard-sized printing plate removing button to transmit a signal representative of this action to the control device. Upon receiving this signal, the control device actuates the second driving device of the tail edge clamp 4 to move the movable part 7 and the base part 8 in the second direction (the left hand side direction in FIG. 2) to loosen the printing plate 10, and bring the movable parts 5 and 7 of the leading edge clamp 3 and tail edge clamp 4 into the open states, thereby releasing the leading and tail edges 10*a* and 10*b* of the printing plate 10 from the clamped states. Both clamps 3 and 4 are held in the open states under the control of the control device. The releasing action of the leading edge la of the printing plate 10 through the opening of the movable part 5 may be made just before the operator pulls the leading edge 10*a* away from the leading edge clamp 3. This pulling action will be later described.

After the above action, the control device actuates the plate cylinder driving motor to reversely rotate the plate cylinder 1 and stops the same at a standard-sized printing plate removing position where the tail edge clamp 4 faces the safety cover.

The operator then opens the safety cover, pulls the tail edge 10*b* out of the tail edge clamp 4, and again pushes the standard-sized printing plate removing button with the retrieved tail edge 10*b* held by hand. Once the control device receives a signal representative of this action from the button, it actuates the printing plate driving motor to reversely rotate the plate cylinder 1. Through this reverse rotation, the operator can gradually remove the printing plate 10 from the plate cylinder 1, advancing from the tail edge 10*b* to the leading edge 10*a*. Once the plate cylinder 1 is reversely rotated to a position where the leading edge clamp 3 faces the safety cover, the control device stops the rotation of the plate cylinder 1. At this point, the operator pulls the leading edge 10*a* out of the leading edge clamp 3 through the safety cover so that the printing plate 10 is completely removed from the plate cylinder 1.

On the other hand, when the shorter-sized printing plate removing mode is to be selected, the shorter-sized printing plate removing button is pushed. Upon receiving a signal representative of this switching action, the control device actuates only the driving device of the leading edge clamp 3 to bring the movable part 5 into the open state and hence release the leading edge 10*a* from the clamped state. The control device also forwardly rotates the plate cylinder 1 to a shorter-sized printing plate removing position where the leading edge clamp 3 faces the safety cover, and stops the same at this position.

The operator then opens the safety cover and pulls the leading edge 10*a* out of the leading edge clamp 3 through the cover by hand. Among the printing plates 10 having a shorter size than the standard size, the printing plate having a relatively short size can be removed from the plate cylinder 1 only by pulling the leading edge 10*a* away from the plate cylinder 1 without the necessity to rotate the plate cylinder 1. On the other hand, the printing plate 10 having a relatively long size, the operator preferably pushes the shorter-sized printing plate removing button again for the forward rotation of the plate cylinder 1. The operator holds the leading edge 10*a* and pulls the same away from the plate cylinder 1 by hand through the forward rotation of the plate cylinder 1, so that the printing plate 10 can easily be removed such as through revealing action gradually advancing from the leading edge 10*a* towards the tail edge 10*b*. The plate cylinder 1 stops after about one rotation thereof.

Thus, the printing plate removing operation can be made by suitably selecting the operational mode according to the length of the printing plate 10 wound around the plate cylinder 1. Specifically, when the shorter-sized printing plate removing mode has been selected, the plate cylinder 1 is rotated not in the reverse direction but in the forward direction. With this forward rotation, it is possible to prevent accidental removal of the printing plate 10 from the plate cylinder 1 and subsequent curling up of the same, which may be caused by the reverse rotation of the plate cylinder 1. Thus, the printing plate 10 can be removed in easy and secured manner.

In both the standard-sized printing plate removing mode or shorter-sized printing plate removing mode, the control device does not actuate the edge insertion device 17 and the pressing roller 15.

In the above description, the standard-sized printing plate feeding button, the shorter-sized printing plate feeding button, the standard-sized printing plate removing button and the shorter-sized printing plate removing button are arranged separately from each other. To reduce these buttons, a mode switching button for switching the operational mode between a first operation mode using the standard-sized printing plate and a second operation mode using the shorter-sized printing plate may be added, through which the four buttons respectively prepared for these two type operations can be reduced to two buttons namely a printing plate feeding button and a printing plate removing button.

In the above arrangement, the switching of the operational mode between the standard-sized printing plate feeding mode, the shorter-sized printing plate feeding mode, the standard-sized printing plate removing mode, and the shorter-sized printing plate removing mode is made through pushing actions of the corresponding buttons. This switching action of each mode may however be varied.

As described above, the sheet-fed printing press of the present invention is operable in the shorter-sized printing plate feeding mode besides the standard-sized printing plate feeding mode, so that the operator can suitably select the plate feeding mode according to the size of the printing plate 10. Thus, the plate feeding operation time for the shorter-sized printing plate may be shortened.

Where the printing press is operable in the shorter-sized printing plate removing mode besides the standard-sized printing plate removing mode, a suitable plate removing mode may be selected according to the size of the printing plate 10. Particularly in the shorter-sized printing plate removing mode, the control device controls the plate cylinder 1 to forwardly rotate. This forward rotation prevents the printing plate 10 from being accidentally removed from the plate cylinder 1 and then curling up, so that the printing plate 10 can be removed from the plate cylinder 1 in easy and secured manner.

This specification is by no means intended to restrict the present invention to the preferred embodiments set forth therein. Various modifications to the sheet-fed printing press, as described herein, may be made by those skilled in the art without departing from the spirit and scope of the present invention as defined in the appended claims.

What is claimed is:

1. A sheet-fed printing press comprising:

a plate cylinder rotatable in the forward direction and the reverse direction, and having an outer circumference around which a printing plate having a leading edge and a tail edge located opposite to each other is wound;

a first clamp device disposed on the plate cylinder for clamping the leading edge of the printing plate;

a second clamp device disposed on the plate cylinder for clamping the tail edge of the printing plate, and said second clamp device being movable in a first direction to pull the printing plate into tensed state and in a second direction to release the printing plate from the tensed state;

a control device for controlling the printing press, so that said printing press is operable in a standard-sized printing plate feeding mode for feeding a printing plate having a standard size on the outer circumference of the plate cylinder and a shorter-sized printing plate feeding mode for feeding a printing plate having a shorter size than said standard size on the outer circumference of the plate cylinder;

wherein when the standard-sized printing plate feeding mode is selected, the control unit controls the printing press so that the plate cylinder is rotated in the forward direction with said leading edge of the printing plate clamped by the first clamp device, thereby enabling said printing plate to be wound around the plate cylinder, and the second clamp device clamps the tail edge and is moved in the first direction, thereby pulling the printing plate into tensed state and hence bringing the printing plate into tight contact with the outer circumference of the plate cylinder, and thus the printing plate feeding operation is completed; and wherein when the shorter-sized printing plate feeding mode is selected, the control unit controls the printing press so that the plate cylinder is rotated in the forward direction with said leading edge of the printing plate clamped by the first clamp device, thereby enabling said printing plate to be wound around the plate cylinder, and thus the printing plate feeding operation is completed without actuation of the second clamp device.

2. A sheet-fed printing press according to claim 1, wherein:

said printing press is operable in a standard-sized printing plate removing mode and a shorter-sized printing plate removing mode;

wherein when the standard-sized printing plate removing mode is selected, the control unit controls the printing press so that the plate cylinder is rotated in the reverse direction with the tail edge of the printing plate released from clamped engagement with the second clamp device; and wherein when the shorter-sized printing plate removing mode is selected, the control unit controls the printing press so that the plate cylinder is rotated in the forward direction with the leading edge of the printing plate released from clamped engagement with the first clamp device.

* * * * *